US008152164B2

(12) United States Patent
Yamamoto et al.

(10) Patent No.: US 8,152,164 B2
(45) Date of Patent: Apr. 10, 2012

(54) IMAGE FORMING APPARATUS

(75) Inventors: Ryoichi Yamamoto, Toyohashi (JP); Hiroyuki Maeda, Toyokawa (JP); Naoki Nonoyama, Toyokawa (JP); Kuniaki Ohbayashi, Toyohashi (JP); Ryo Hirano, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 12/951,459

(22) Filed: Nov. 22, 2010

(65) Prior Publication Data

US 2011/0148035 A1 Jun. 23, 2011

(30) Foreign Application Priority Data

Dec. 18, 2009 (JP) ..... 2009-287241

(51) Int. Cl.
*B65H 9/04* (2006.01)

(52) U.S. Cl. ..... 271/242; 271/258.01; 271/265.01; 271/270

(58) Field of Classification Search ..... 271/242, 271/258.01, 265.01, 270
See application file for complete search history.

(56) References Cited

U.S. PATENT DOCUMENTS

| | | | | |
|---|---|---|---|---|
| 5,775,690 | A * | 7/1998 | Quesnel et al. | 271/242 |
| 7,347,419 | B2 * | 3/2008 | Sano et al. | 271/265.04 |
| 7,604,233 | B2 * | 10/2009 | Nakazawa et al. | 271/242 |
| 2007/0284811 | A1 * | 12/2007 | Nakazawa et al. | 271/242 |

FOREIGN PATENT DOCUMENTS

JP 8-220928 A 8/1996

* cited by examiner

*Primary Examiner* — David H Bollinger
(74) *Attorney, Agent, or Firm* — Buchanan Ingersoll & Rooney PC

(57) ABSTRACT

An image forming apparatus including first and second pairs of rollers for feeding a print medium; the second pair of rollers being disposed downstream from the first pair of rollers; a first detector for detecting the print medium slack in a specified degree by contact with the print medium, the first detector being disposed between the first pair of rollers and the second pair of rollers; a second detector for detecting either the first pair of rollers or the second pair of rollers need a specified value of driving torque; and a controller for controlling either a feeding speed at which the print medium is fed by the first pair of rollers or a feeding speed at which the print medium is fed by the second pair of rollers based on either outputs from the first detector or outputs from the second detector.

5 Claims, 11 Drawing Sheets

IMAGE FORMING APPARATUS

This application is based on Japanese Patent Application No. 2009-287241 filed on Dec. 18, 2009, of which content is incorporated herein by reference.

BACKGROUND OF THE INVENTION

1. Field of the Invention

The present invention relates to an image forming apparatus, and more particularly to an image forming apparatus for transferring an image onto a print medium.

2. Description of Related Art

Conventional image forming apparatuses form toner images generally by a method as described below. First, an optical scanning device emits a beam to an electrified photosensitive drum, whereby an electrostatic latent image is formed on the surface of the photosensitive drum. Next, a developing device supplies toner to the surface of the photosensitive drum, whereby the electrostatic latent image is developed into a toner image. Meanwhile, a feed roller picks up a sheet from a stack of sheets stored in a sheet tray. Next, a pair of registration rollers feeds the sheet picked up by the feed roller. A transfer roller, which is disposed opposite to the photosensitive drum, transfers the toner image from the surface of the photosensitive drum to the sheet fed by the pair of registration rollers. Next, the sheet is subjected to a heat/pressure treatment performed by a fixing device, whereby the toner image is fixed on the sheet. Thereafter, the sheet is ejected onto a printed-sheet tray.

Such an image forming apparatus is also structured such that a sheet slacks while the sheet is present between a nip portion of the photosensitive drum and the transfer roller (a transfer position) and the fixing device, for the following reason. When the sheet feeding speed of the fixing device is higher than the sheet feeding speed of the photosensitive drum and the transfer roller, it is impossible that a sheet slacks between the transfer position and the fixing device. In this case, tension is applied to a sheet, and the photosensitive drum and the transfer roller slip. Thereby, the quality of the toner image transferred onto the sheet is lowered. In order to prevent this problem, the sheet feeding speed of the photosensitive drum and the transfer roller is set higher than the sheet feeding speed of the fixing device. Thereby, a sheet slacks between the transfer position and the fixing device, and the sheet is prevented from being subjected to tension.

However, in such an image forming apparatus, if a sheet slacks excessively, the quality of the toner image transferred onto the sheet is lowered. More specifically, if a sheet slacks excessively, the sheet will be returning straight. Accordingly, the part of the sheet present in the fixing device, which is located more downstream in a sheet path, is forced forward and downstream, and the part of the sheet present between the photosensitive drum and the transfer roller, which are located upstream in the sheet path, is forced backward and upstream. Therefore, the photosensitive drum and the transfer roller slip, and consequently, the quality of the toner image transferred onto the sheet is lowered. Therefore, it is desired that a sheet slacks moderately between the transfer position and the fixing device.

In a conventional image forming apparatus, degradation of a toner image is prevented by use of a detection mechanism as will be described below. FIG. 11 shows a photosensitive drum 502, a transfer roller 504 and a fixing device 506 in a conventional image forming apparatus 500.

The image forming apparatus 500 has a detection mechanism 508 as well as the photosensitive drum 502, the transfer roller 504 and the fixing device 506. The photosensitive drum 502, the transfer roller 504 and the fixing device 506 operate as described above, and descriptions thereof are omitted here. The detection mechanism 508 is to detect a sheet P slacking, and the detection mechanism 508 comprises a lever 508*a* and a sensor 508*b*. The lever 508*a* is a stick-like member. The center of the lever 508*a* in the lengthwise direction is fixed, and the lever 508*a* is capable of pivoting on a body of the image forming apparatus 500 in a direction shown by the arrow. The sensor 508*b* is disposed near the lever 508*a*, and the sensor 508*b* comprises a light emitting element and a light receiving element. When the sheet P is tense, the lever 508*a* interrupts the light emitting element and the light receiving element of the sensor 508*b*. When the sheet P slacks, the lever 508*a* is pushed by the sheet P and pivots clockwise. Thereby, as shown in FIG. 11, the lever 508*a* retreats from the interrupting position between the light emitting element and the light receiving element. In this way, in the image forming apparatus 500, the detection mechanism 508 detects the sheet P slack, and a control section (not shown) controls the sheet feeding speed of the fixing device 506 in accordance with the output from the detection mechanism 508 so that the sheet P will slack moderately.

In the image forming apparatus 500, however, it is difficult to certainly prevent degradation of a toner image for the following reason. Various kinds of sheets can be used as the sheet P. Specifically, various materials of sheets, for example, cardboard sheets, ordinary sheets, etc. and various sizes of sheets, for example, A4-sized sheets, A3-sized sheets, etc. can be used as the sheet P. The ease of slacking of the sheet P depends on the kind of the sheet P, and even when the sheet P slacks in a degree, it will or will not result in degradation of a toner image on the sheet P.

In this apparatus 500, the detection mechanism 508 can detect the sheet P slack only in a certain degree. Therefore, when the sheet P is a type of sheet that is easy to slack, detection of a slack of the sheet P serves the purpose of preventing degradation of a toner image. On the other hand, when the sheet P is a type of sheet that is hard to slack, although the sheet P is in such a condition to cause degradation of a toner image, the detection mechanism may not detect the condition, resulting in a failure in preventing degradation of a toner image.

In a conventional image forming apparatus disclosed by Japanese Patent Laid-Open Publication No. 8-220928, the conditions of the heat/pressure treatment carried out by the fixing device are changed depending on the kind of the recording paper. However, Japanese Patent Laid-Open Publication No. 8-220928 is silent about preventing degradation of a toner image by making a slack of the sheet P.

SUMMARY OF THE INVENTION

An object of the present invention is to provide an image forming apparatus that can prevent degradation of an image transferred onto a print medium.

In order to attain the object, an image forming apparatus according to an embodiment of the present invention comprises: a first pair of rollers for feeding a print medium; a second pair of rollers for feeding the print medium, the second pair of rollers being disposed downstream in a print medium feeding direction from the first pair of rollers; a first detector for detecting the print medium slack in a specified degree by contact with the print medium, the first detector being disposed between the first pair of rollers and the second pair of rollers; a second detector for detecting either the first pair of rollers or the second pair of rollers need a specified value of driving torque; and a controller for controlling either a feeding speed at which the print medium is fed by the first pair of rollers or a feeding speed at which the print medium is fed by the second pair of rollers based on either outputs from the first detector or outputs from the second detector; wherein if the first detector detects the print medium slack in the specified degree earlier than the second detector detects the first pair of rollers or the second pair of rollers need the specified value of driving torque after feeding of the print medium starts, the controller controls the feeding speed based on outputs from the first detector, and if the second detector detects the first pair of rollers or the second pair of rollers need the specified value of driving torque earlier than the first detector detects the print medium slack in the specified degree after feeding of the print medium starts, the controller controls the feeding speed based on outputs from the second detector.

BRIEF DESCRIPTION OF THE DRAWINGS

This and other objects and features will be apparent from the following description with reference to the accompanying drawings, in which.

DETAILED DESCRIPTION OF THE PREFERRED EMBODIMENTS

An image forming apparatus according to an embodiment of the present invention is hereinafter described with reference to the accompanying drawings.

Structure of the Image Forming Apparatus

Figure 1:
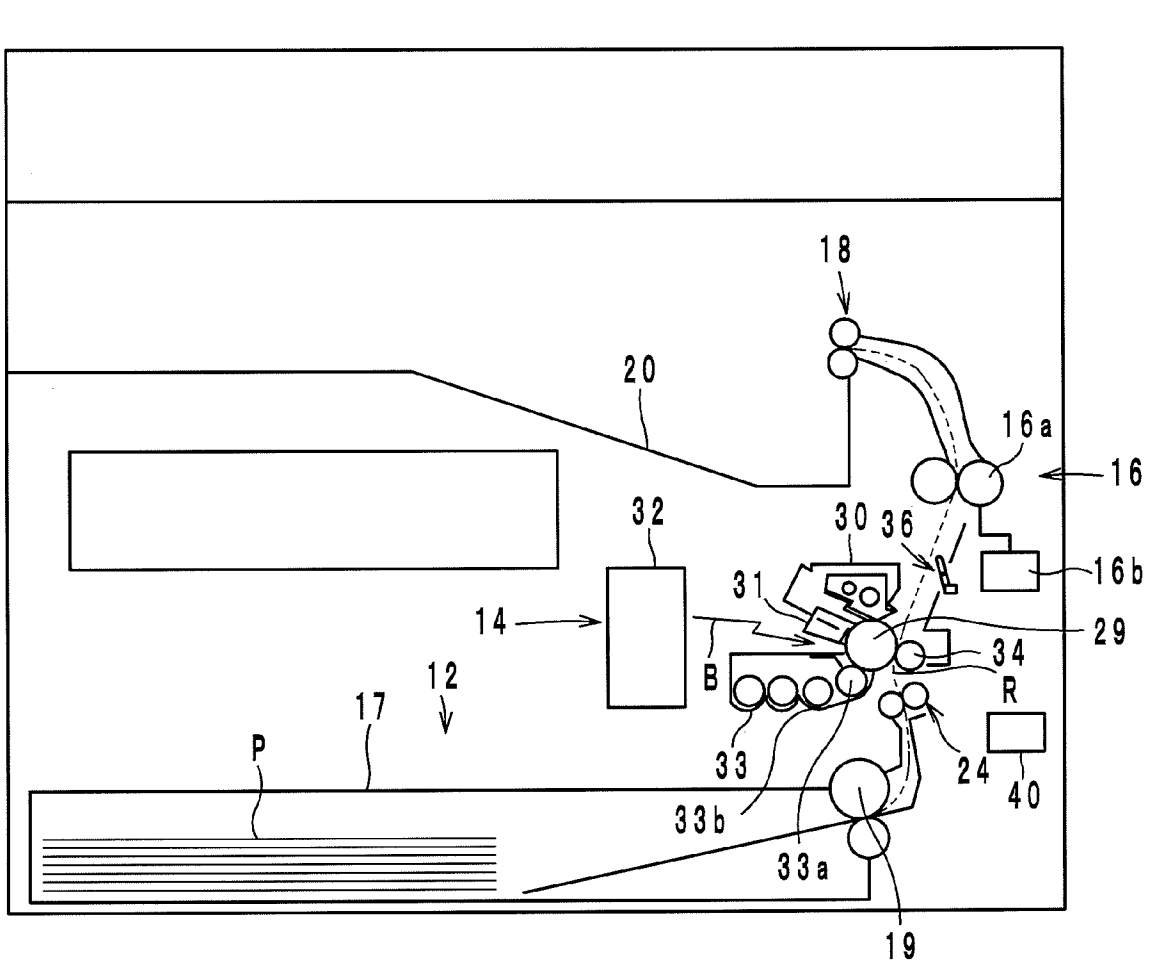
FIG. 1 is a skeleton framework of an image forming apparatus according to an embodiment of the present invention.
Figure 2:
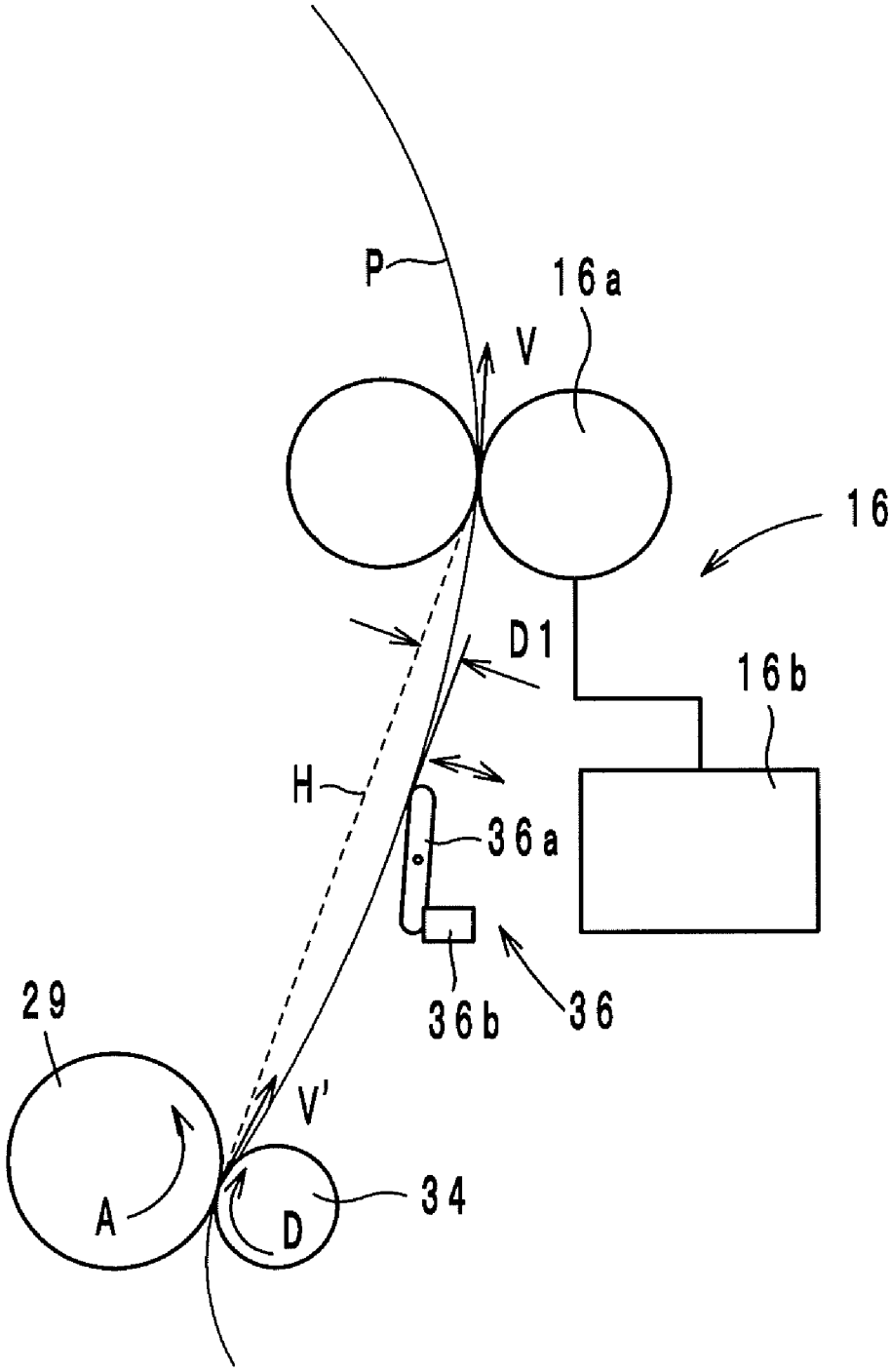
FIG. 2 is an enlarged view of a part of the image forming apparatus shown by FIG. 1.
Figure 3:
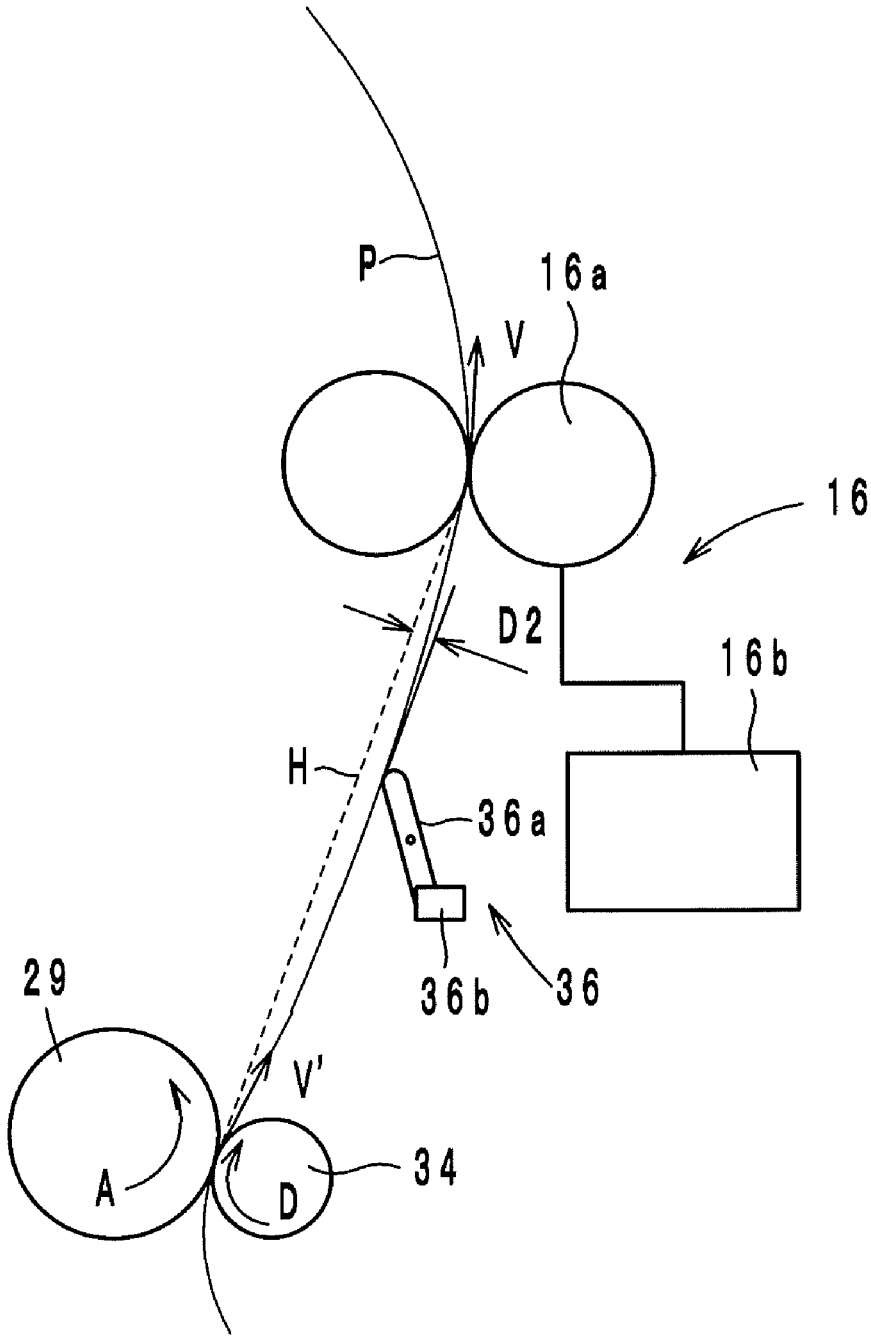
FIG. 3 is an enlarged view of the part of the image forming apparatus shown by FIG. 1.
Figure 4:
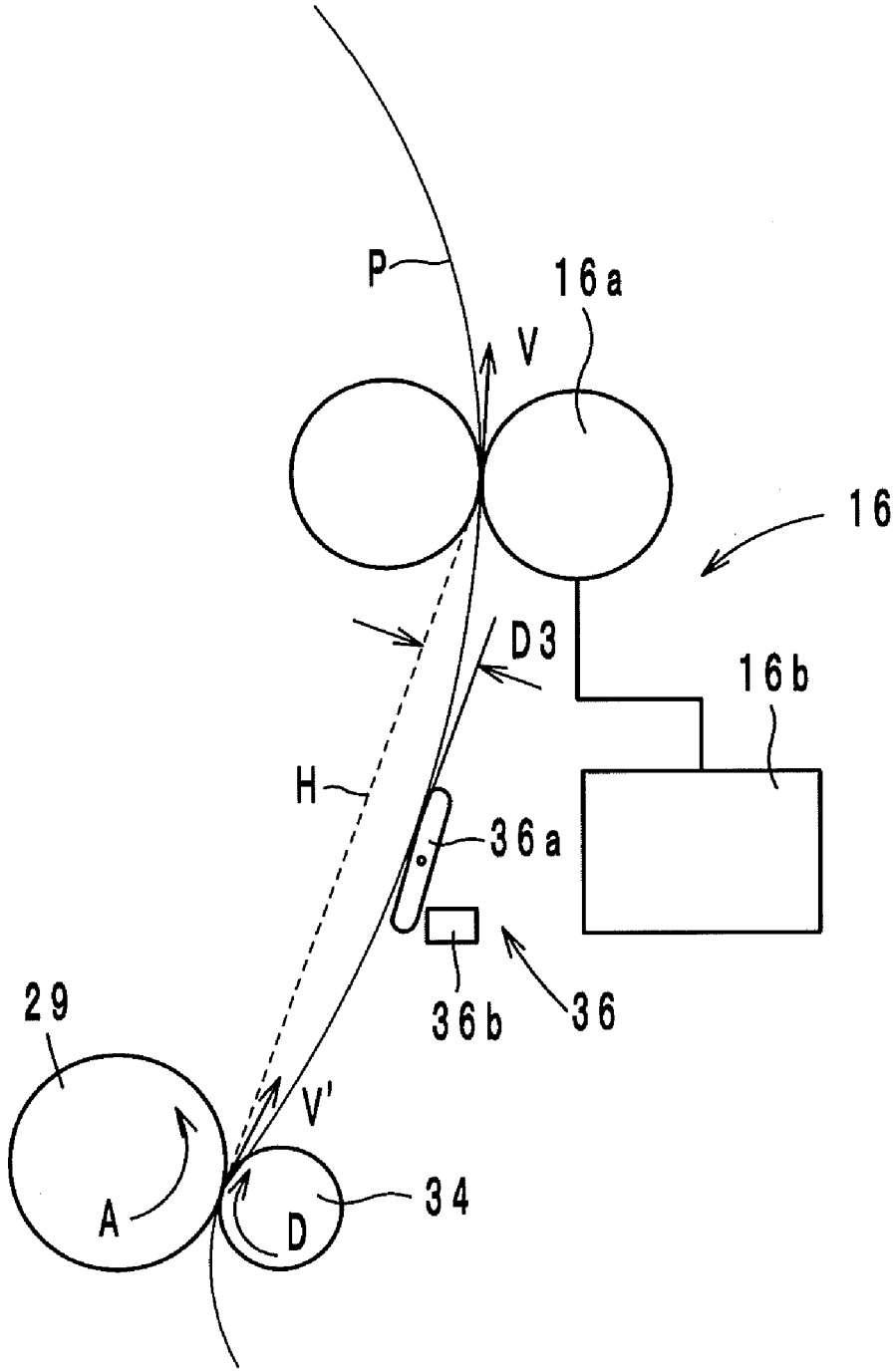
FIG. 4 is an enlarged view of the part of the image forming apparatus shown by FIG. 1.

First, referring to the drawings, the image forming apparatus is described. FIG. 1 is a skeleton framework of the image forming apparatus 10 according to an embodiment of the present invention. FIGS. 2 to 4 are enlarged views of a part of the image forming apparatus 10. In the following paragraphs, a front surface of a sheet means a surface of a sheet on which an image is printed, and a back surface of a sheet means a surface of a sheet on which an image is not printed.

The image forming apparatus 10 is an electrophotographic copying machine or printer. As shown in FIG. 1, the image forming apparatus 10 comprises a sheet feed unit 12, an image forming unit 14, a fixing unit 16, a pair of ejection rollers 18, a printed-sheet tray 20, a detection mechanism (first detector) 36 and a control section (a controller and a second detector) 40.

The control section 40 is, for example, a CPU, and controls the entire image forming apparatus 10. The sheet feed unit 12 comprises a sheet tray 17 and a feed roller 19. Sheets of a print medium P are stacked in the sheet tray 17. The feed roller 19 feeds the sheets P out of the sheet tray 17 one by one. Each sheet fed out of the sheet tray 17 is fed to the image formation unit 14 via a pair of registration rollers 24.

The image formation unit 14 is to form a toner image (transferred image) on a sheet P. The image formation unit 14 comprises a photosensitive drum 29, a cleaner 30, a charger 31, an optical scanning device 32, a developing device 33 and a transfer roller 34. The image formation unit 14 will be described in more detail later.

The fixing unit 16 comprises a pair of fixing rollers 16*a*, and the pair of fixing rollers 16*a* fixes a toner image on the sheet P. The pair of fixing rollers 16*a* is disposed downstream from a pair of rollers composed of the photosensitive drum 29 and the transfer roller 34 in a sheet feeding direction, and the pair of fixing rollers 16*a* feeds the sheet P further. More specifically, the pair of fixing rollers 16*a* is composed of two rollers leaning against each other. The pair of fixing rollers 16*a* is driven to rotate by a motor 16*b*. After receiving a toner image transferred thereon in the image formation unit 14, the sheet P is caused to pass through between the pair of fixing rollers 16*a* by the rotation of the pair of fixing rollers 16*a*. In the meantime, the sheet P is subjected to a heat/pressure treatment. In this way, the toner image is fixed on the sheet P by the pair of fixing rollers 16*a*. In the following paragraphs, the speed at which the pair of fixing rollers 16*a* feeds the sheet P is referred to as a sheet feeding speed V (see FIG. 2).

The pair of ejection rollers 18 ejects the sheet P fed from the fixing unit 16 to the printed-sheet tray 20. Thereby, the sheet P with an image printed thereon is ejected onto the printed-sheet tray 20.

Next, the structure of the image formation unit 14 is described with reference to FIGS. 1 and 2.

As shown by FIG. 2, the sheet P, after being fed out of the sheet tray 17 by the feed roller 19, is fed to between the photosensitive drum 29 and the transfer roller 34 via the pair of registration rollers 24 at a specified time to enable transfer of a toner image onto the sheet P.

The photosensitive drum 29 is cylindrical and functions as a supporting member for supporting a toner image. The photosensitive drum 29 is driven by a motor or the like (not shown) to rotate in a direction "A" (counterclockwise) as shown in FIG. 2.

As shown in FIG. 1, a charger 31 is disposed to face to the surface of the photosensitive drum 29 and charges the surface of the photosensitive drum 29. The optical scanning device 32 is, as shown in FIG. 1, disposed to face to the photosensitive drum 29 at a position downstream from the charger 31 in the direction "A". The optical scanning device 32 emits a beam B to the surface of the photosensitive drum 29 in accordance with image data outputted from an image reading device (scanner) or a computer, controlled by the control section 40. Thereby, an electrostatic latent image is formed on the surface of the photosensitive drum 29.

As shown in FIG. 1, the developing device 33 is disposed to face to the photosensitive drum 29 at a position downstream from the optical scanning device 32 in the direction "A", and forms a toner image on the photosensitive drum 29. The developing device 33, as shown in FIG. 1, comprises a developing roller 33*a* and a case 33*b*. The developing roller 33*a* is disposed in the case 33*b*, and toner is filled in the case 33*b*. As shown in FIG. 1, the developing roller 33*a* is cylindrical. The developing roller 33*a* is partly exposed from the case 33*b* and faces to the surface of the photosensitive drum 29. The developing roller 33*a* is rotated by a motor or the like (not shown) to transport the toner from the case 33*b* to the photosensitive drum 29. Thereby, on the surface of the photosensitive drum 29, a toner image is formed in accordance with the electrostatic latent image. Although the developing device 33 further comprises supply rollers and other elements, descriptions thereof are omitted.

The transfer roller 34 is to transfer the toner image to the sheet P fed by the pair of registration rollers 24. More specifically, the transfer roller 34 is disposed to face to the photosensitive drum 29 at a position downstream from the developing device 33 in the direction "A", and the transfer roller 34 and the photosensitive drum 29 compose a pair of nipper rollers. In this structure, while the sheet P is passing between the transfer roller 34 and the photosensitive drum 29, the transfer roller 34 transfers the toner image from the photosensitive drum 29 to the sheet P. That is, the toner image is transferred onto the sheet P by the pair of rollers composed of the photosensitive drum 29 and the transfer roller 34. The transfer roller 34 is driven by a motor or the like (not shown) to rotate in a direction "D" (clockwise) as shown in FIG. 2, and the pair of rollers composed of the photosensitive drum 29 and the transfer roller 34 feeds the sheet P. In the following paragraphs, the speed at which the pair of rollers composed of the photosensitive drum 29 and the transfer roller 34 feeds the sheet P is referred to as a sheet feeding speed V' (see FIG. 2).

As shown in FIG. 1, the cleaner 30 is disposed to face to the photosensitive drum 29 at a position downstream from the transfer roller 34 in the direction "A". The cleaner 30 takes up toner that remains on the surface of the photosensitive drum 29.

Next, referring to FIGS. 2 to 4, the detection mechanism 36 is described. The detection mechanism 36, as shown in FIG. 2, is to detect the sheet P slacking at a specified degree by contact with the sheet P, and is disposed between the pair of rollers composed of the photosensitive drum 29 and the transfer roller 34 and the pair of fixing rollers 16*a*. The detection mechanism 36 has a lever 36*a* and a sensor 36*b*. The lever 36*a* is a stick-like member, and the center of the lever 36*a* in the lengthwise direction is fixed to the body of the image forming apparatus 10 such that the lever 36*a* is capable of pivoting in the direction shown by the arrow. The sensor 36*b* is disposed near the lever 36*a*, and comprises a light emitting element and a light receiving element.

When the sheet P slacks a little (for example, D2 shown in FIG. 3), the lever 36*a* cuts into an optical path between the light emitting element and the light receiving element of the sensor 36*b*. In this state, the sensor 36*b* is OFF.

When the sheet P slacks more (for example, D1 shown in FIG. 2), the lever 36*a* is pushed by the sheet P and pivots clockwise. Consequently, the lever 36*a* retreats from the optical path between the light emitting element and the light receiving element of the sensor 36*b*. Thereby, the sensor 36*b* is turned ON.

When the sheet P slacks farther more (for example, D3 shown in FIG. 4), the lever 36*a* is pushed by the sheet P and pivots clockwise farther. In this state, the lever 36*a* does not cut into the optical path between the light emitting element and the light receiving element of the sensor 36*b*, and the sensor 36*b* is ON.

A slack of the sheet P means that the sheet P runs off a plane H connecting the nip portion between the photosensitive drum 29 and the transfer roller 34 to the nip portion between the pair of fixing rollers 16*a*. The degree of the slack is shown by a distance between the plane H and the farthest point of the slacking sheet P from the plane H.

Figure 5:
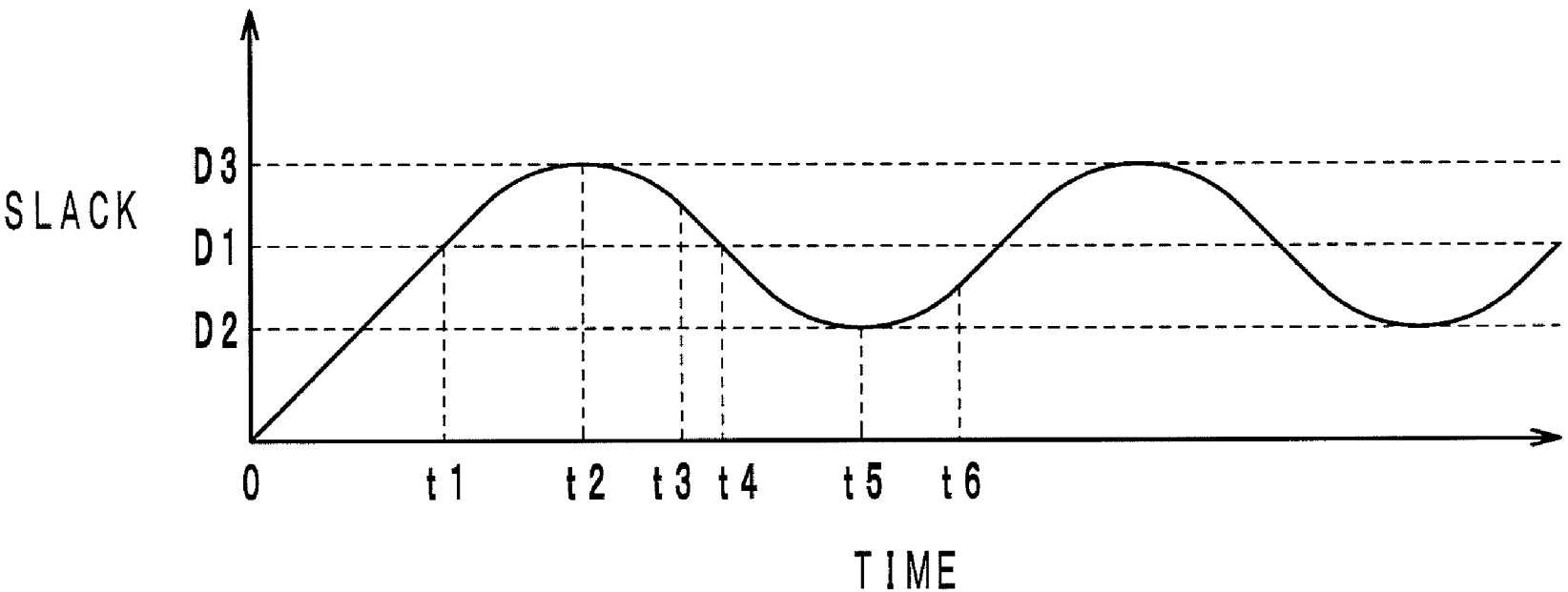
FIG. 5 is a graph showing the relationship between the degree of a slack of a sheet and time.

In this way, by reading the sensor 36*b* of the detection mechanism 36 whether to be ON or OFF, it can be judged whether the sheet P slacks within or beyond the degree of D1. Then, based on the detection result concerning the degree of the slack of the sheet P, the control section 40 controls the motor 16*b* to control the sheet feeding speed V at which the pair of fixing rollers 16*a* feeds the sheet P. In the following paragraphs, control of the sheet feeding speed V by the control section 40 will be described with reference to the drawings. FIG. 5 is a graph showing the relationship between the degree of the slack of the sheet P and the time. The y-axis shows the degree of the slack of the sheet P, and the x-axis shows the time.

The control section 40 controls the sheet feeding speed V of the pair of fixing rollers 16*a* such that the slack of the sheet P will be closer to D1. First, when feeding of the sheet P is started, the control section 40 controls the sheet feeding speed V of the fixing rollers 16*a* such that the sheet P will slack in a degree of D1. More specifically, from time 0 to time t1, the control section 40 controls the sheet feeding speed V to be a speed V2. The speed V2 is lower than the sheet feeding speed V' at which the photosensitive drum 29 and the transfer roller 34 feed the sheet P. Thereby, as shown in FIG. 5, from time 0 to time t1, the sheet P slacks more and more as time goes on, and in the meantime, the sensor 36*b* is kept OFF as shown by FIG. 3.

Thereafter, when the slack of the sheet P becomes D1 (at time t1), the sensor 36*b* is turned ON from OFF (see FIG. 2). In response to this change of the sensor 36*b*, the control section 40 changes the sheet feeding speed V to V1. The speed V1 is higher than the sheet feeding speed V' of the photosensitive drum 29 and the transfer roller 34. At this time, however, because the motor 16*b* cannot change its rotation speed instantly, the rotation speed of the motor 16*b* changes gradually. Accordingly, the sheet feeding speed V becomes the speed V1 actually at time t3 in FIG. 5. From time t1 to time t3, the degree of the slack of the sheet P changes as a sinusoidal wave. More specifically, from time t1 to time t2, the difference between the speed V and the speed V' is getting smaller, and thereby, the growing rate of the slack of the sheet P is getting lower. When the speed V becomes equal to the speed V' (at time t2), the slack of the sheet P comes to the maximum D3. Thereafter, because the speed V becomes higher than the speed V', the slack of the sheet P shrinks.

When the slack of the sheet P becomes D1 (at time t4), the sensor 36*b* is turned from ON to OFF. In response to this change of the sensor 36*b*, the control section 40 changes the sheet feeding speed V to V2. However, because the motor 16*b* cannot change its rotation speed instantly, the rotation speed of the motor 16*b* changes gradually. Accordingly, the sheet feeding speed V becomes the speed V2 actually at time t6 in FIG. 5. From time t4 to time t6, the degree of the slack of the sheet P changes as a sinusoidal wave. More specifically, from time t4 to time t5, the difference between the speed V and the speed V' is getting smaller, and thereby, the shrinking rate of the slack of the sheet P is getting lower. When the speed V becomes equal to the speed V' (at time t5), the slack of the sheet P comes to the minimum D2. Thereafter, because the speed V becomes lower than the speed V', the slack of the sheet P grows.

As described above, the control section 40 changes the sheet feeding speed V between V1 and V2 in response to changes of the sensor 36*b* between ON and OFF. Thereby, the degree of the slack of the sheet P changes as a sinusoidal wave between D2 and D3.

Figure 6:
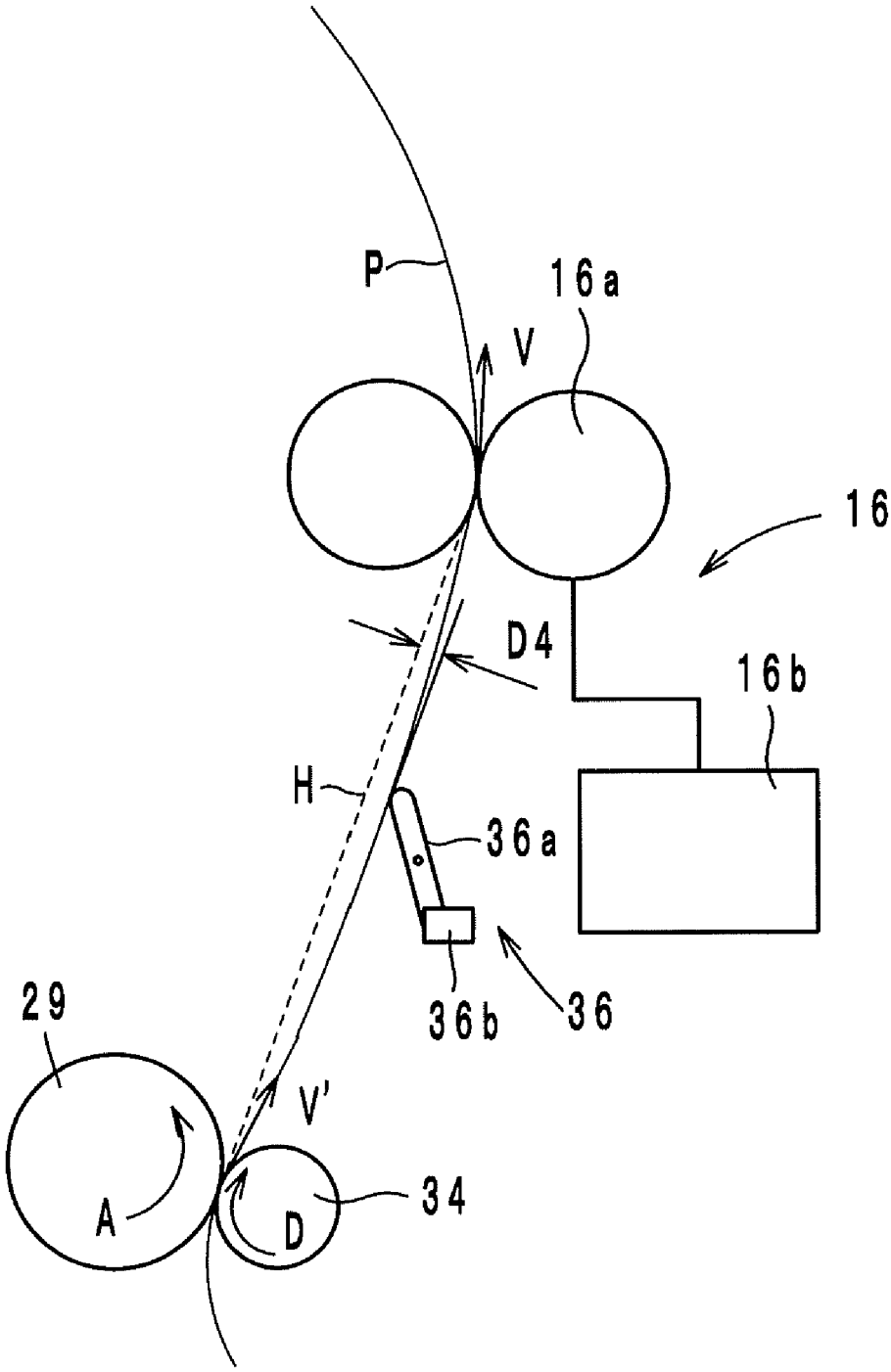
FIG. 6 is an enlarged view of the part of the image forming apparatus shown by FIG. 1.
Figure 7:
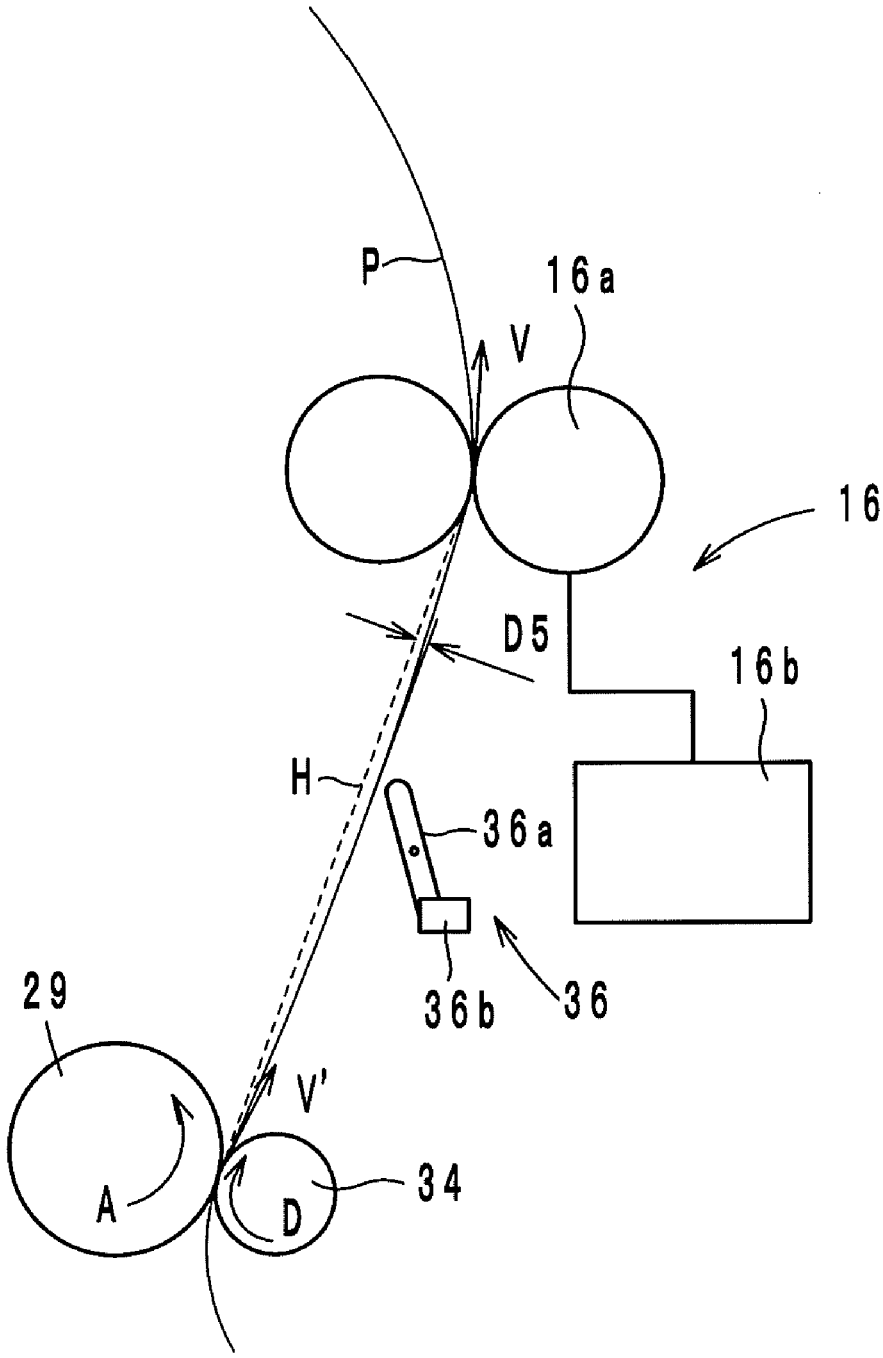
FIG. 7 is an enlarged view of the part of the image forming apparatus shown by FIG. 1.
Figure 8:
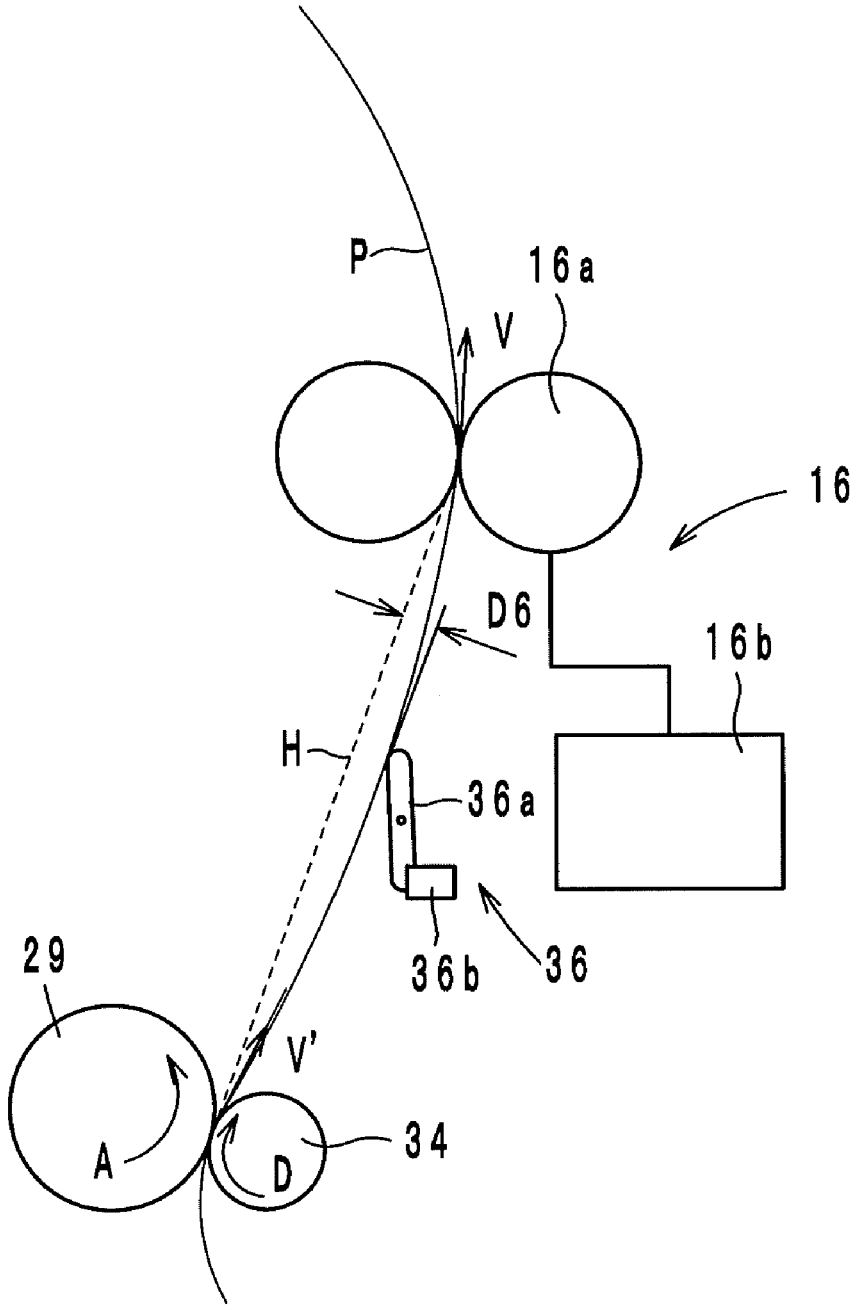
FIG. 8 is an enlarged view of the part of the image forming apparatus shown by FIG. 1.

Further, the control section 40 controls the sheet feeding speed V in accordance with a torque T needed to drive the pair of fixing rollers 16*a* as well as in response to the outputs from the detection mechanism 36. In the following, the control of the sheet feeding speed V in accordance with the driving torque T for the pair of fixing rollers 16*a* will be described with reference to the drawings. FIGS. 6 to 8 are enlarged views of a part of the image forming apparatus 10.

The motor 16*b* drives the pair of fixing rollers 16*a*. When the slack of the sheet P is relatively in a great degree, the torque T needed to drive the pair of fixing rollers 16*a* is relatively small. This is because the sheet P, when it slacks relatively largely, has a relatively large force to return to its straight posture, whereby the part of the sheet P around the pair of fixing rollers 16*a* is pushed relatively strongly in the sheet feeding direction. On the other hand, when the slack of the sheet P is relatively in a small degree, the torque T needed to drive the pair of fixing rollers 16*a* is relatively large. This is because the sheet P, when it slacks relatively small, has a relatively small force to return to its straight posture, whereby the part of the sheet P around the pair of fixing rollers 16*a* is pushed relatively weakly in the sheet feeding direction.

Figure 9:
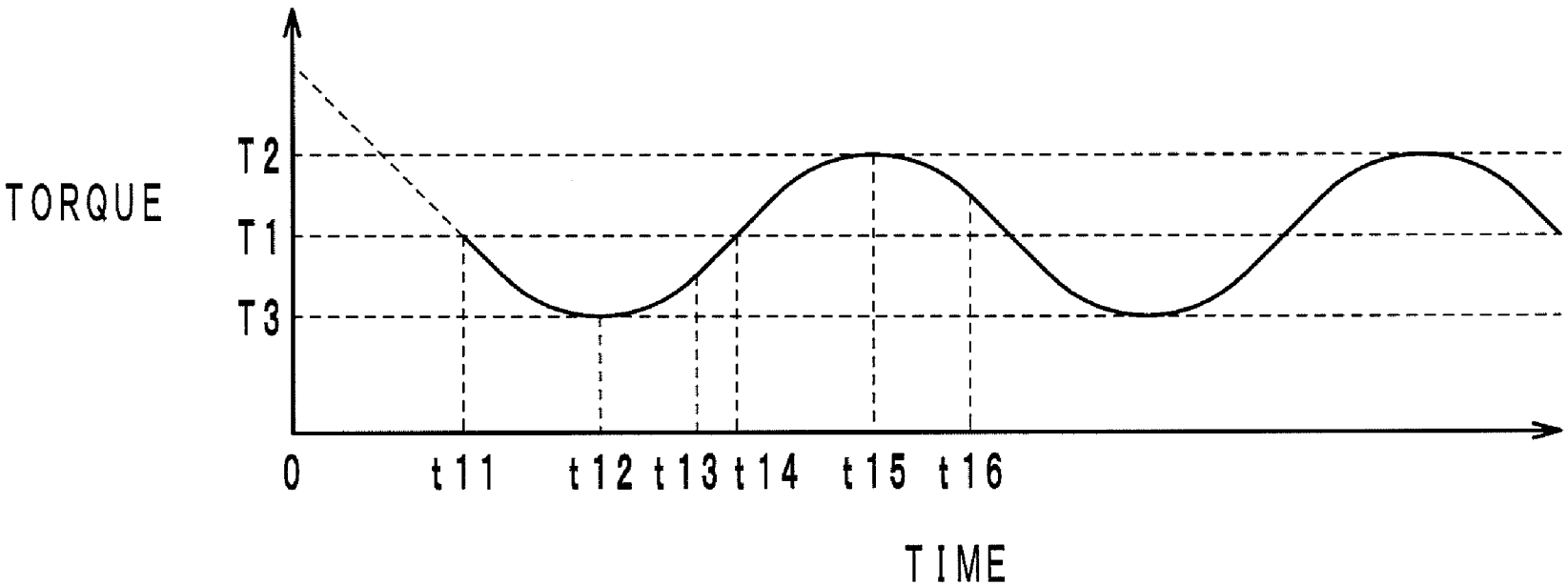
FIG. 9 is a graph showing the relationship between the magnitude of a driving torque and time.

The control section 40 detects whether the driving torque T for the pair of fixing rollers 16*a* is a specified value T1. It is possible to detect the driving torque T by measuring the current flowing in the motor 16*b*. Specifically, the control section 40 detects whether the driving torque T for the pair of fixing rollers 16*a* by detecting whether a specified current flows in the motor 16*b*. As shown by FIG. 6, the degree of the slack of the sheet P when the driving torque T for the pair of fixing rollers 16*a* is detected T1 is denoted by D4. Further, as shown by FIG. 7, when the slack of the sheet P is in a degree of D5, which is smaller than D4, the driving torque T for the pair of fixing rollers 16*a* is T2. As shown by FIG. 8, when the slack of the sheet P is in a degree of D6, which is larger than D4, the driving torque T for the pair of fixing rollers 16*a* is denoted by T3. The torque T2 is larger than the torque T1, and the torque T3 is smaller than the torque T1. The control section 40 controls the sheet feeding speed V of the pair of fixing rollers 16*a* in accordance with values detected as the driving torque T. FIG. 9 is a graph showing the relationship between the driving torque T and the time. In the graph of FIG. 9, the y-axis shows values of the torque T and the x-axis shows the time.

When feeding of the sheet P is started, the control section 40 controls the sheet feeding speed V of the pair of fixing rollers 16*a* such that the driving torque T for the pair of fixing rollers 16*a* will be T1 (in other words, such that the slack of the sheet P will be D4). More specifically, between time t0 and time t11, the control section 40 keeps the sheet feeding speed V at V2.

Thereafter, the driving torque T for the pair of fixing rollers 16*a* becomes smaller than T1 (at time t11), and at this time, the control section 40 changes the sheet feeding speed V to V1. However, because the motor 16*b* cannot change its rotation speed instantly, the rotation speed of the motor 16*b* changes gradually. Therefore, the sheet feeding speed V becomes V1 actually at time t13 in FIG. 9. Thus, between time t11 to time t13, the driving torque T changes as a sinusoidal wave. More specifically, between time t11 and time t12, the difference between the speed V and the speed V' is getting smaller, and the falling rate of the driving torque T is getting lower. When the speed V becomes equal to the speed V' (at time t12), the driving torque T for the pair of fixing rollers 16*a* becomes the minimum T3. At this time, the slack of the sheet P becomes the maximum D6. Thereafter, because the speed V becomes higher than the speed V', the slack of the sheet P shrinks, and the driving torque T rises.

When the driving torque T for the pair of fixing rollers 16*a* becomes larger than T1 (at time t14), the control section 40 changes the sheet feeding speed V to V2. However, because the motor 16*b* cannot change its rotation speed instantly, the rotation speed of the motor 16*b* changes gradually. Therefore, the sheet feeding speed V becomes V2 actually at time t16 in FIG. 9. Thus, between time t14 to time t16, the driving torque T changes as a sinusoidal wave. More specifically, between time t14 and time t15, the difference between the speed V and the speed V' is getting smaller, and the rising rate of the driving torque T is getting lower. When the speed V becomes equal to the speed V' (at time t15), the driving torque T for the pair of fixing rollers 16*a* becomes the maximum T2. At this time, the slack of the sheet P becomes the minimum D5. Thereafter, because the speed V becomes lower than the speed V', the slack of the sheet P grows, and the driving torque T falls.

As described above, the control section 40 switches the sheet feeding speed V between V1 and V2 in response to detections of the specified value T1 as the driving torque T for the pair of fixing rollers 16*a*. Accordingly, the driving torque T changes as a sinusoidal wave between T2 and T3. Likewise, the slack of the sheet P changes as a sinusoidal wave between D5 and D6.

In the image forming apparatus 10, depending on the ease of slacking of the sheet P, the control section 40 controls the sheet feeding speed V based on either outputs from the detection mechanism 36 or detection results of the driving torque T. This will be described below.

The detection mechanism 36 is capable of detecting a relatively easy-to-slack sheet P slack. However, it is difficult for the detection mechanism 36 to detect a relatively hard-to-slack sheet P slack. Therefore, when a relatively hard-to-slack sheet P is fed, if the detection mechanism 36 detects the sheet P slack even in a small degree within D2 to D3, there is fear that the toner image transferred onto the sheet P may degrade.

In contrast, when a relatively hard-to-slack sheet P is fed, the driving torque T for the pair of fixing rollers 16*a* fluctuates relatively largely, and when a relatively easy-to-slack sheet P is fed, the driving torque T for the pair of fixing rollers 16*a* fluctuates relatively small. Therefore, when a relatively easy-to slack sheet P is fed, even if the driving torque T is within a range from T2 to T3, the sheet P may slack too largely, thereby resulting in degradation of a toner image transferred onto the sheet P.

In order to avoid such trouble, in the image forming apparatus 10, when a relatively easy-to-slack sheet P is fed, the control section 40 controls the sheet feeding speed V in accordance with the degree of slack of the sheet P. On the other hand, when a relatively hard-to-slack sheet P is fed, the control section 40 controls the sheet feeding speed V in accordance with the magnitude of the driving torque T. In order to conduct this control, the control section 40 controls the sheet feeding speed V of the pair of fixing rollers 16*a* in accordance with either the degree of the slack of the sheet or the magnitude of the driving torque T, depending on which is detected earlier, D1 or T1. Specifically, after feeding of a sheet P is started, if the sensor 36*b* detects the sheet P slack in the degree of D1 first, from then onward, the control section 40 will control the sheet feeding speed V of the pair of fixing rollers 16*a* based on outputs from the detection mechanism 36. On the other hand, if the control section 40 detects the driving torque T become T1 first, from then onward, the control section 40 will control the sheet feeding speed V of the pair of fixing rollers 16*a* based on detection results of the driving torque T.

Operation of the Image Forming Apparatus

Figure 10:
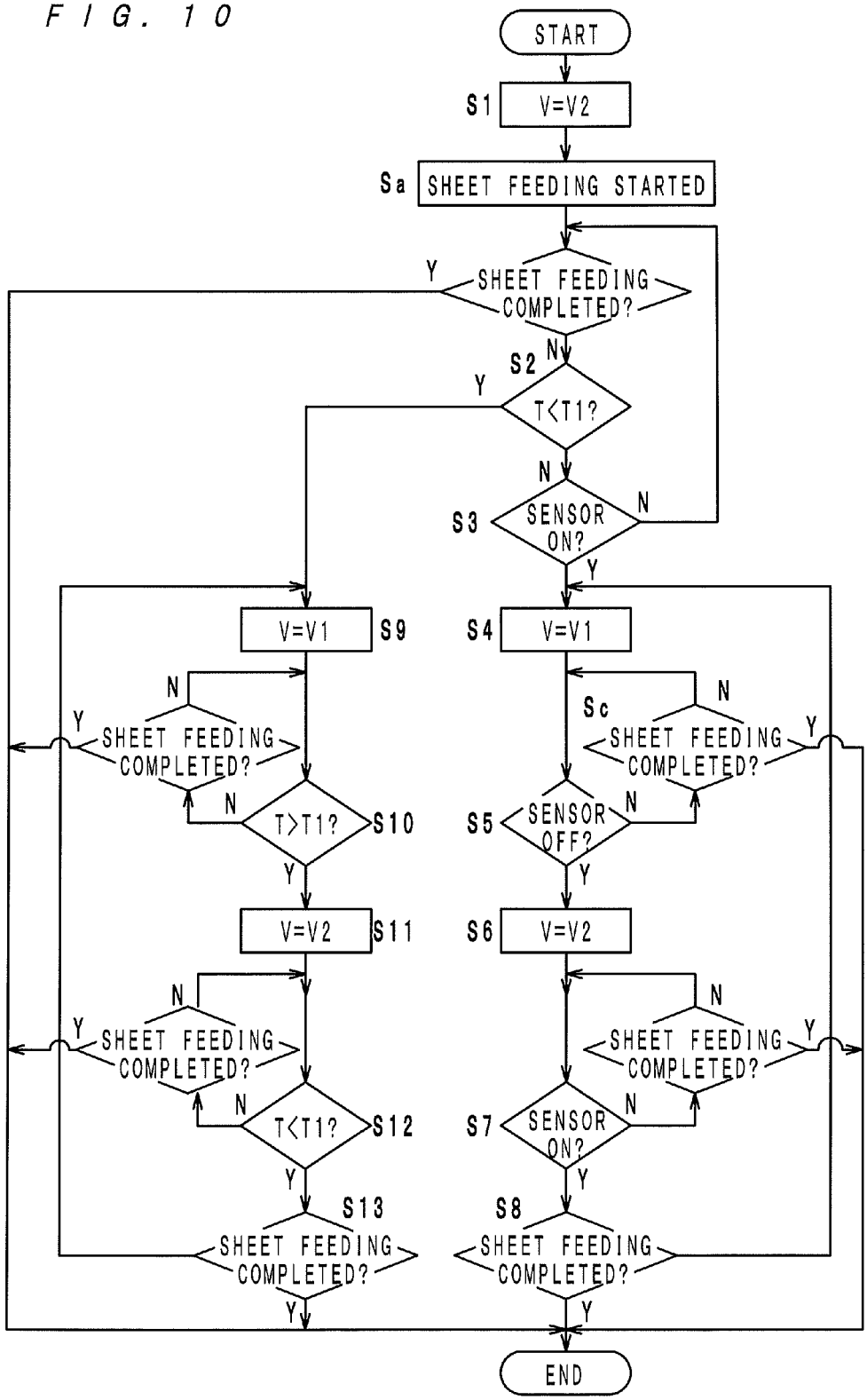
FIG. 10 is a flowchart showing a procedure carried out by a control section.
Figure 11:
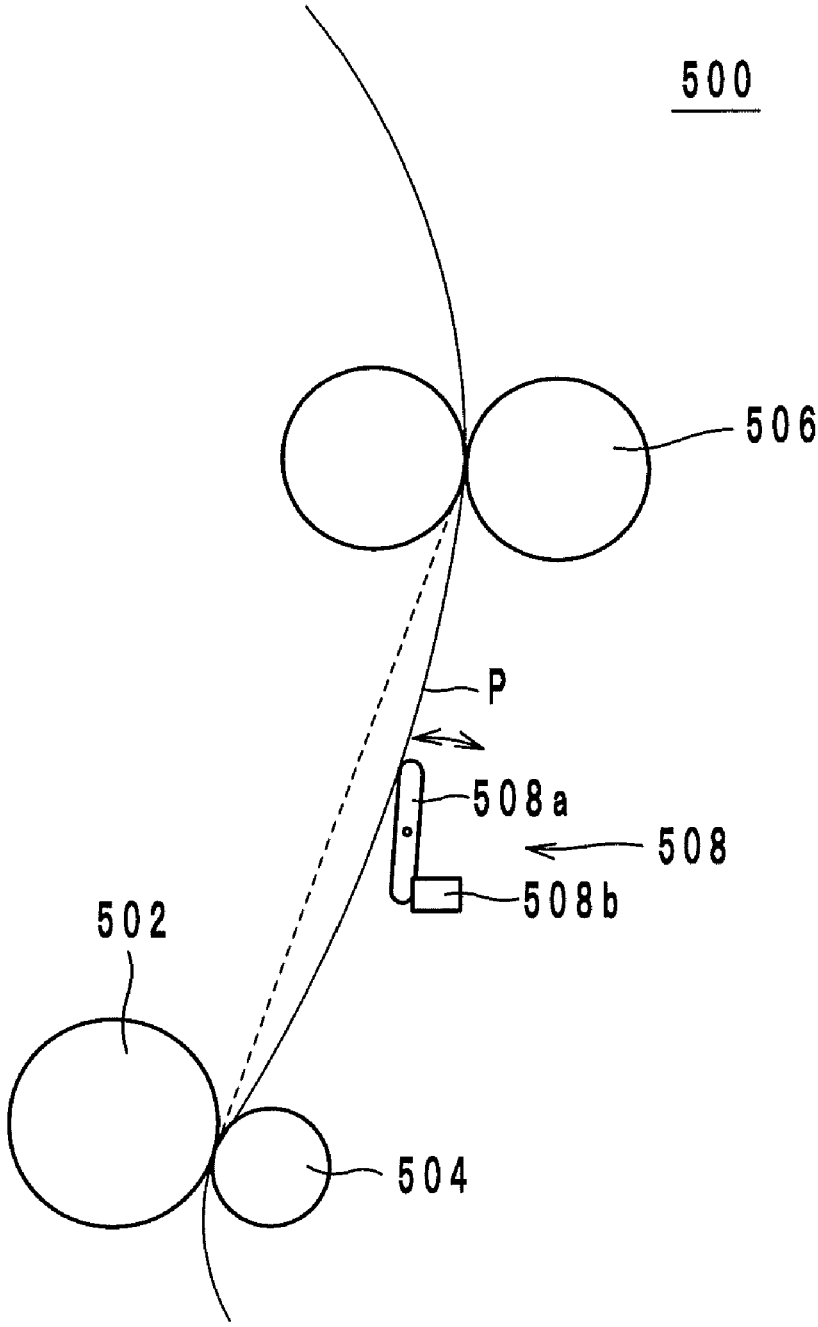
FIG. 11 is an enlarged view of a photosensitive drum, a transfer roller and a fixing device in a conventional image forming apparatus.

Operation of the image forming apparatus 10 will be described below. FIG. 10 is a flowchart showing the procedure carried out by the control section 40.

When a command for image formation is made by a user's input or is sent from a computer, the control section 40 starts operating the elements of the image forming apparatus 10 and controls the motor 16*b* so that the sheet feeding speed V of the pair of fixing rollers 16*a* will be V2 (step S1). Next, the control section 40 starts feeding of a sheet P from the sheet tray 17 by use of the feed roller 19, the registration rollers 24 and other sheet feeding rollers (step Sa). Thereafter, the processing goes to step Sb.

Next, the control section 40 judges whether the feeding of the sheet P is completed (step Sb). On completion of the feeding of the sheet P, this procedure is completed. When the feeding of the sheet P has not been completed, the processing goes to step S2.

When the feeding of the sheet P has not been completed, the control section 40 checks whether the driving torque T is smaller than T1 (step S2). Step S2 is a step of judging whether the sheet P is a relatively hard-to-slack sheet. If the driving torque T is not smaller than T1, the processing goes to step S3. If the driving torque T is smaller than T1, the processing goes to step S9.

When it is judged at step S2 that the driving torque T is not smaller than T1, the control section 40 next checks whether the sensor 36*b* is turned from OFF to ON (step S3). Step S3 is a step of judging whether the sheet P is a relatively easy-to-slack sheet. When the sensor 36*b* is turned from OFF to ON, the processing goes to step S4. While the sensor 36*b* is kept OFF, the processing returns to step Sb. Thus, the processes at steps Sb, S2 and S3 are repeated until the driving torque T is judged to be smaller than T1 at step S2, until the sensor 36*b* is judged to be turned from OFF to ON at step S3 or until feeding of the sheet P is judged to be completed at step Sb. In this way, from the results of the steps S2 and S3, the control section 40 judges which is earlier, the time when the sensor 36*b* detects the sheet P slack in the degree of D1 or the time when the driving torque T becomes T1.

When the sensor 36*b* is turned from OFF to ON, the control section 40 sets the sheet feeding speed V to V1 (step S4). Thereby, the sheet feeding speed V becomes higher, and the degree of the slack of the sheet P becomes smaller.

Next, the control section 40 checks whether the sensor 36*b* is turned from ON to OFF (step S5). Step 5 is a step of judging whether the slack of the sheet P becomes smaller than D1. When the sensor 36*b* is turned from ON to OFF, the processing goes to step S6. While the sensor 36*b* is kept ON, the processing goes to step Sc.

While the sensor 36*b* is kept ON, the control section 40 judges whether the feeding of the sheet P has been completed (step Sc). When completion of the feeding of the sheet P is judged, the processing is completed. When the feeding of the sheet P has not been completed, the processing returns to step S5.

When the sensor 36*b* is turned from ON to OFF, the control section 40 sets the sheet feeding speed V to V2 (step S6). Thereby, the sheet feeding speed V becomes lower, and the slack of the sheet P becomes larger.

Next, the control section 40 checks whether the sensor 36*b* is turned from OFF to ON (step S7). Step S7 is a step of judging whether the slack of the sheet P becomes larger than D1. When the sensor 36*b* is turned from OFF to ON, the processing goes to step S8. While the sensor 36*b* is kept OFF, the processing goes to step Sd.

While the sensor 36*b* is kept OFF, the control section 40 checks whether the feeding of the sheet P has been completed (step Sd). When completion of the feeding of the sheet P is judged, the processing is completed. When the feeding of the sheet P has not been completed, the processing returns to step S7.

When the sensor 36*b* is turned from OFF to ON, the control section 40 checks whether the feeding of the sheet P has been completed (step S8). On completion of the feeding of the sheet P, the processing is completed. When the feeding of the sheet P has not been completed, the processing returns to step S4. The processes at steps S4 to step S8 are repeated until the feeding of the sheet P is completed.

When the driving torque T is judged to be smaller than T1 at step S2, the control section 40 sets the sheet feeding speed V to V1 (step S9). Thereby, the sheet feeding speed V becomes higher. Consequently, the slack of the sheet P becomes smaller, and the driving torque T becomes larger.

Next, the control section 40 checks whether the driving torque T is larger than T1 (step S10). When the driving torque T becomes larger than T1, the processing goes to step S11. When the driving torque T is not larger than T1, the processing goes to step Se.

When the driving torque T is not judged to be larger than T1 at step S10, the control section 40 checks whether the feeding of the sheet P has been completed (step Se). When completion of the feeding of the sheet P is judged, the processing is completed. When the feeding of the sheet P has not been completed, the processing returns to step S10.

When the driving torque T becomes larger than T1, the control section sets the sheet feeding speed V to V2 (step S11). Thereby, the sheet feeding speed V becomes smaller. Consequently, the slack of the sheet P becomes larger, and the driving torque T becomes larger.

Next, the control section 40 checks whether the driving torque T becomes smaller than T1 (step S12). When the driving torque T is judged to be smaller than T1, the processing goes to step S13. When the driving torque T is not judged to be smaller than T1, the processing goes to step Sf.

When the driving torque T is not judged to be smaller than T1, the control section 40 checks whether the feeding of the sheet P has been completed (step Sf). When completion of the feeding of the sheet is judged, the processing/is completed. When the feeding of the sheet has not been completed, the processing returns to step S12.

When the driving torque T is judged to be smaller than T1, the control section 40 checks whether the feeding of the sheet P has been completed (step S13). When completion of the feeding of the sheet P is judged, the processing is completed. When the feeding of the sheet P has not been completed, the processing returns to step S9. The processes at steps S9 to step S13 are repeated until the feeding of the sheet P is completed.

Advantages

The image forming apparatus 10 of the above-described structure can prevent degradation of a toner image transferred onto a sheet P. It is easy for the detection mechanism 36 to detect a relatively easy-to-slack sheet slack. However, it is difficult for the detection mechanism 36 to detect a relatively hard-to-slack sheet slack. Therefore, when the detection mechanism 36 detects a relatively hard-to-slack sheet P slack even in a small degree such as D2 to D3, the sheet P may have a great force to straighten up, which may degrade a toner image transferred onto the sheet P.

The driving torque T for a pair of rollers fluctuates greatly in feeding a relatively hard-to-slack sheet P, but the driving torque T for a pair of rollers fluctuates small in feeding a relatively easy-to-slack sheet P. Therefore, during feeding of a relatively easy-to-slack sheet P, if the control section 40 detects the driving torque T even within a range from T2 to T3, the toner image transferred to the sheet P may degrade.

In the image forming apparatus 10, when a relatively easy-to-slack sheet P is fed, the control section 40 controls the sheet feeding speed V in accordance with the degree of the slack of the sheet P detected by the detection mechanism 36. On the other hand, when a relatively hard-to-slack sheet P is fed, the control section 40 controls the sheet feeding speed V in accordance with detected values of the driving torque T. In order to implement this control, the control section 40 controls the sheet feeding speed V of the pair of fixing rollers 16*a* based on either outputs from the sensor 36*b* or detection results of the driving torque T, depending on which is detected earlier, D1 or T1. More specifically, if the sensor 36*b* detects the sheet P slack in the degree D1 before the control section 40 detects the driving torque T become T1, the sheet P is judged to be a relatively easy-to-slack sheet. In this case, the speed V to feed the sheet P is controlled based on the degree of the slack of the sheet P detected by the detection mechanism 36. On the other hand, if the control section 40 detects the driving torque T become T1 before the sensor 36*b* detects the sheet P slack in the degree D1, the sheet P is judged to be a relatively hard-to-slack sheet. In this case, the speed V to feed the sheet P is controlled based on the driving torque T detected by the control section 40. In this way, the speed V to feed a sheet P is controlled in a way appropriate for the sheet P, and degradation of a toner image transferred onto the sheet P is prevented.

The degree D1 of the slack of the sheet P is such a value not to cause degradation of a toner image transferred onto a relatively easy-to-slack sheet P. The torque T1 is such a value not to cause degradation of a toner image transferred onto a relatively hard-to-slack sheet P.

Now, the ease of slacking of the sheet P is described. Regarding sheets of the same material and of the same thickness, the wider the sheet is, the harder to slack the sheet is. The narrower the sheet is, the easier to slack the sheet is. Regarding sheets of the same material and of the same width, the thicker the sheet is, the harder to slack the sheet is. The thinner the sheet is, the easier to slack the sheet is. Regarding sheets of the same thickness and of the same width, the harder the material is, the harder to slack the sheet is. The softer the material is, the easier to slack the sheet is.

According to the image forming apparatus 10 of this embodiment, degradation of a toner image transferred onto a sheet can be prevented.

Other Embodiments

In the image forming apparatus 10, the control section 40 detects the driving torque T for the pair of fixing rollers 16*a* while the transfer of a toner image onto the sheet P is carried out between the photosensitive drum 29 and the transfer roller 34. However, the control section 40 may detect the driving torque T for the photosensitive drum 29 and the transfer roller 34 for the control of the sheet feeding speed.

In the image forming apparatus 10, the control section 40 controls the sheet feeding speed V at which the pair of fixing rollers 16*a* feeds the sheet P. However, the control section 40 may control the sheet feeding speed V' at which the photosensitive drum 29 and the transfer roller 34 feeds the sheet P.

Further, the image forming apparatus 10 is not limited to the structure shown by FIG. 1. For example, the image forming apparatus 10 may be of a type comprising a plurality of developing devices 33 to form a color image. Also, the image forming apparatus 10 may be of a type comprising an intermediate transfer member (for example, an intermediate transfer belt) and performing second transfer of a toner image from the intermediate transfer member to the sheet P by the transfer roller 34.

Although the present invention has been described in connection with the preferred embodiments above, it is to be noted that various changes and modifications are possible to those who are skilled in the art. Such changes and modifications are to be understood as being within the scope of the invention.

What is claimed is:

1. An image forming apparatus comprising:

a first pair of rollers for feeding a print medium;

a second pair of rollers for feeding the print medium, the second pair of rollers being disposed downstream in a print medium feeding direction from the first pair of rollers;

a first detector for detecting the print medium slack in a specified degree by contact with the print medium, the first detector being disposed between the first pair of rollers and the second pair of rollers;

a second detector for detecting either the first pair of rollers or the second pair of rollers need a specified value of driving torque; and a controller for controlling either a feeding speed at which the print medium is fed by the first pair of rollers or a feeding speed at which the print medium is fed by the second pair of rollers based on either outputs from the first detector or outputs from the second detector;

wherein if the first detector detects the print medium slack in the specified degree earlier than the second detector detects the first pair of rollers or the second pair of rollers need the specified value of driving torque after feeding of the print medium starts, the controller controls the feeding speed based on outputs from the first detector, and if the second detector detects the first pair of rollers or the second pair of rollers need the specified value of driving torque earlier than the first detector detects the print medium slack in the specified degree after feeding of the print medium starts, the controller controls the feeding speed based on outputs from the second detector.

2. An image forming apparatus according to claim 1, wherein the second detector detects the driving torque of one of the first pair of rollers and the second pair of rollers, and transfer of an image is carried out at the other of the first pair of rollers and the second pair of rollers.

3. An image forming apparatus according to claim 2, wherein the first pair of rollers is to transfer an image to the print medium; and wherein the second pair of rollers is to fix the transferred image onto the print medium.

4. An image forming apparatus according to claim 1, wherein that the print medium slacks means that the print medium runs off a plane connecting a nip portion between the first pair of rollers to a nip portion between the second pair of rollers.

5. An image forming apparatus according to claim 1, further comprising a motor for driving either the first pair of rollers or the second pair of rollers, wherein the second detector detects the driving torque for the first pair of rollers or the second pair of rollers by measuring a current flowing in the motor.

* * * * *